US005189971A

United States Patent [19]

Frankel et al.

[11] Patent Number: 5,189,971

[45] Date of Patent: Mar. 2, 1993

[54] ELECTRONIC SEWING MACHINE

[76] Inventors: Samuel R. Frankel, 211 Maple St., Shillington, Pa. 19607; Meghanad D. Wagh, 3131 Clifton Ave., Bethlehem, Pa. 18017

[21] Appl. No.: 605,030

[22] Filed: Oct. 29, 1990

[51] Int. Cl.[5] ..... D05B 69/10

[52] U.S. Cl. ..... 112/220; 112/231; 112/121.11; 112/262.1

[58] Field of Search ..... 112/220, 221, 228, 229, 112/231, 262.1, 453, 320, 121.11

[56] References Cited

U.S. PATENT DOCUMENTS

| | | | |
|---|---|---|---|
| 3,425,376 | 2/1969 | Brynge et al. | 112/220 |
| 4,241,680 | 12/1980 | Hinch et al. | 112/221 X |
| 4,917,031 | 4/1990 | Itoh | 112/320 X |

*Primary Examiner*—Peter Nerbun

*Attorney, Agent, or Firm*—Caesar, Rivise, Bernstein, Cohen & Pokotilow, Ltd.

[57] ABSTRACT

An electronic sewing machine whose needle bar assembly is made to reciprocate by means of a pair of cooperating solenoids in conjunction with a bobbin driven by a stepping motor to accomplish the sewing. The stepping motor's steps are made variable programmatically by a CPU attached to the machine such that the tightness of a stitch may be controlled. Additionally, the machine may be programmed to deliver a defined number of stitches in a defined number of stitch runs, position the needle up or down, report a variety of accounting and maintenance data and can be taught to perform a variety of sewing runs.

35 Claims, 3 Drawing Sheets

ELECTRONIC SEWING MACHINE

CROSS-REFERENCES

There are no copending applications.

FEDERALLY-SPONSERED RIGHTS

The invention herein was made without any Federal sponsorship or contribution.

BACKGROUND OF THE INVENTION

1. The Field of the Invention.

The field of the invention relates to an improved electronic sewing machine, more particularly of the type in which the needle bar is driven by solenoids.

2. Description of the Prior Art.

Electromagnetic force has been utilized to operate needle bars in sewing machines. Reference is made to U.S. Pat. No. 2,232,692 (Feb. 25, 1941 to Diehl); U.S. Pat. No. 3,425,376 (Feb. 4, 1969 to Brynge, et. al.); U.S. Pat. No. 3,831,537 (Aug. 27, 1974 to Siegel); U.S. Pat. No. 3,881,433 (May 6, 1975 to Davidson); U.S. Pat. No. 4,098,207 (Jul. 4, 1978 to Peterson). Each recognizes that utilization of solenoids and magnetic fields will reduce friction in a sewing machine which is generally dependent on a mechanical transmission with many moving parts. None, however, avoids the fact that somewhere in the driven train an ordinary electric motor is essential to operate a portion of the particular configuration disclosed and more specifically to operate the bobbin.

Of interest is Brynge, et. al. in which the needle bar is reciprocated by changes in the magnetic flux of a permanent magnetic field induced by a movable iron-free driving coil which is synchronized with the bobbin or loop taker. The bobbin is independently driven by a variable speed, rotating electric motor which generates pulses to the drive coil and regulates the stitch rate from a zero to a maximum. The motor itself typically has a magnet bearing wheel which will generate one pulse per wheel rotation as the bobbin is driven through one cycle.

Nowhere in any of the devices referred above nor otherwise presently known to your inventors is a true stepping motor utilized to control stitch cycle and stitch tightness or quality nor of a solenoid-driven sewing machine of such a configuration as to be maximally free of many or continuously moving parts. None is responsive to instructions from a central processing unit for controlling the sewing cycle and each is, as a result, inflexible as to operation except in the variation of the stitch rate.

As is well known in the art, stitch tightness is regulated by repositioning the bobbin assembly's rotation, conventionally by a manually adjustable screw. A variation in sewing together a number of plies or thickness of material, for example, requiring in the middle of a sewing operation, or sewing a thicker elastic material to a lighter non-elastic kind, will cause uneven stitching and might require a manual readjustment to the bobbin assembly to accommodate the change. In and of itself, such uneven stitching could cause rejection by an inspector.

Except for Brynge, each in its operation requires some kind of continuously running drive and clutch arrangement and is therefore energy inefficient. Brynge, as a limitation, does not provide electronic means for regulating stitch quality. Further, the foregoing prior art, or existing apparatus of the type known to your inventors apparatus of the type, provides a way of controlling stitch or run of stitch counts, such prior art in the disclosure is operator dependent for such purposes.

Reference is also made to U.S. application Ser. No. 07/508,221 (Frankel) filed Apr. 17, 1990 now pending an allowed which contains some related subject matter. However, it is not cited as containing prior art.

SUMMARY OF THE INVENTION

An object of the present invention is to provide an electromagnetic sewing machine which is controlled by a CPU which is energy efficient and economical of maintenance by keeping to a minimum the number of moving parts and reducing friction. A further object is to provide an accurate means for controlling the quality of the stitch, that is, its tightness, made by the machine during a sewing operation regardless of the materials to be sewn or the characteristics of the thread utilized in the sewing and without halting the operation to adjust for tightness.

An additional object is to relieve the machine operator of the burden of stitch counting, needle positioning, stitching speed during a run of stitches, and a variety of job reporting functions.

Importantly, an object of the invention is to provide a sewing machine which is "smart" in that it can be taught to perform a series of runs of stitches, the number of stitches in a run, the position of the needle up or down after each run and the tightness required of each stitch based upon stitch configuration, thread to be used and materials to be sewn. A supervisor or machine teacher may identify and instruct and cause to remember through the machine CPU a host CPU as to a new design which has a particular series of sewing operations by sitting at the machine of the invention and performing such operations. The machine CPU transmits this information to the host as instructions for a series of stitch runs in which the needle bar stops with the needle positioned up or down, the number of stitches in each run and how tight each stitch shall be for storage in the host's memory. Thereafter, an operator at the machine of the invention can log on to the host CPU by identifying the new design by an identifying job number and the host will transmit the design instructions back for storage in the machine CPU's memory. The operator thereafter positions the pieces to be sewn under the machine's presser foot, depresses the treadle and guides the pieces through the sewing operation as instructed by the machine CPU.

The machine CPU is also made capable of remembering various accounting and maintenance data such as operator and machine I.D., job number, pieces per job, operating time, and the like which it can forward to the host for compilation and storage.

Accordingly, to accomplish the foregoing, an electronic sewing machine is comprised of an external supply of thread, a cooperating pair of solenoids to provide reciprocating motion up and down for a needle bar assembly, a pulse driven stepper motor to provide a means to adjust the bobbin assembly for control of stitch tightness and to rotate the bobbin assembly, and a treadle which cooperates with a potentiometric circuit to regulate machine speed. The machine has a central processing unit which is programmable to operate it.

In operation, when the treadle is depressed, a signal activates the machine CPU and one of the solenoids causes the needle bar to descend and rise somewhat to form a loop. Simultaneously, the CPU sends a set of instructions as pulses to the stepper motor which is rotatably attached to the bobbin assembly to shift its case from a defined reference position clockwise or counter-clockwise a defined number of degrees, thereby setting the tightness of the stitch. Thereafter, a further set of instructions will drive the stepper motor and bobbin conventionally through its clockwise rotation of 360° so as to take the loop and form and close a stitch. By controlling programmatically the bobbin's reference position at the commencement of bobbin rotation relative to the needle bar's travel, the tightness of the stitch may be varied.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 5 figures are shown on 3 sheets. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
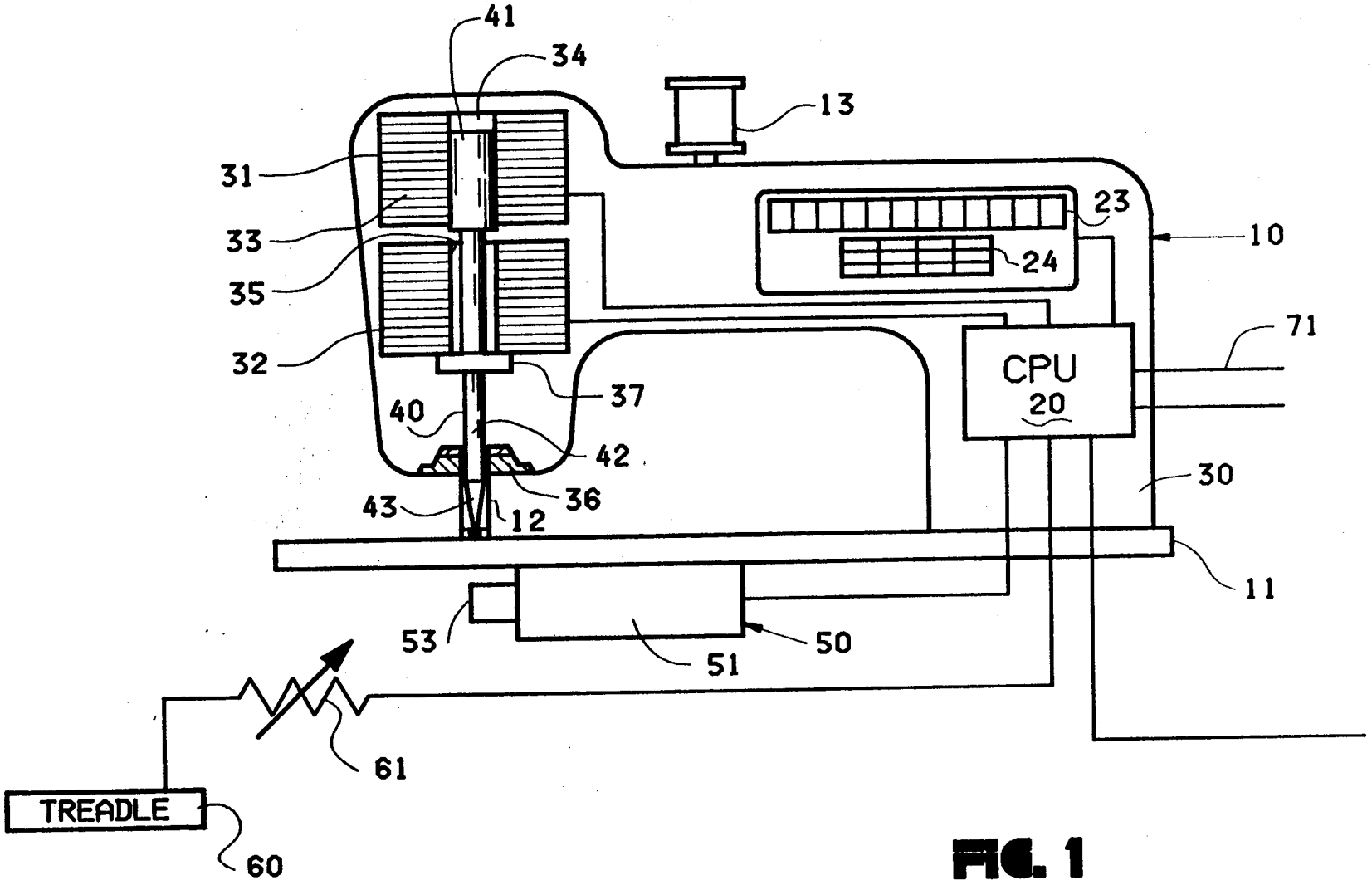
FIG. 1 shows a skeletal side view of a typical configuration or the present invention.

The preferred embodiment is described as an electronic sewing machine 10 comprised of a base plate 11, a first central processing unit 20 mounted on a frame 30 and programmed to send a multiplicity of sets of instructions to the machine's parts, the CPU being equipped with memory to hold programming and data (not shown), a clock 21, a counter 22, a display 23 typically displaying up to eighty characters and a keyboard 24 or pad, the frame 30 being of cantilevered shape mounted to the base plate for holding within the frame in vertical axial alignment, a first or "up" solenoid 31 and a second or "down" solenoid 32. The solenoids may be annularly wire wound 33 in coils around hollow cores 34 which define a passage 35 in which a needle bar assembly 40 can reciprocate up and down and to provide fields of magnetic flux of sufficient strength to cause an iron alloy bar-shaped reciprocator 41 attached to the needle bar assembly to reciprocate between the solenoids when they are activated alternately by a first set of instructions from the first CPU. The needle bar assembly 40, that is the reciprocator, a needle bar 42 and a needle 43, is appropriately guided axially vertically through a defined length 44 of travel path having an up terminus **44*a* and a down terminus 44*b* by journal means 36 and a stopping plate 37, typically made of a noise-reducing material such as polyurethane. Alongside the needle is a presser foot 12. An external source of thread 13** is provided to feed thread under tension by means (not shown) well-known in the art.

Mounted under the base in conventional orientation is a bobbin assembly 50 which is cooperatively attached to a pulse driven stepper motor 51 with a shaft 52 for driving rotationally the bobbin assembly which is equipped with a supply of thread (not shown) through a defined arc of rotation. A treadle 60 is attached to a potentiometer circuit 61 to regulate by foot pressure the number of reciprocations per minute of the needle bar assembly, i.e. the stitch rate.

Figure 4:
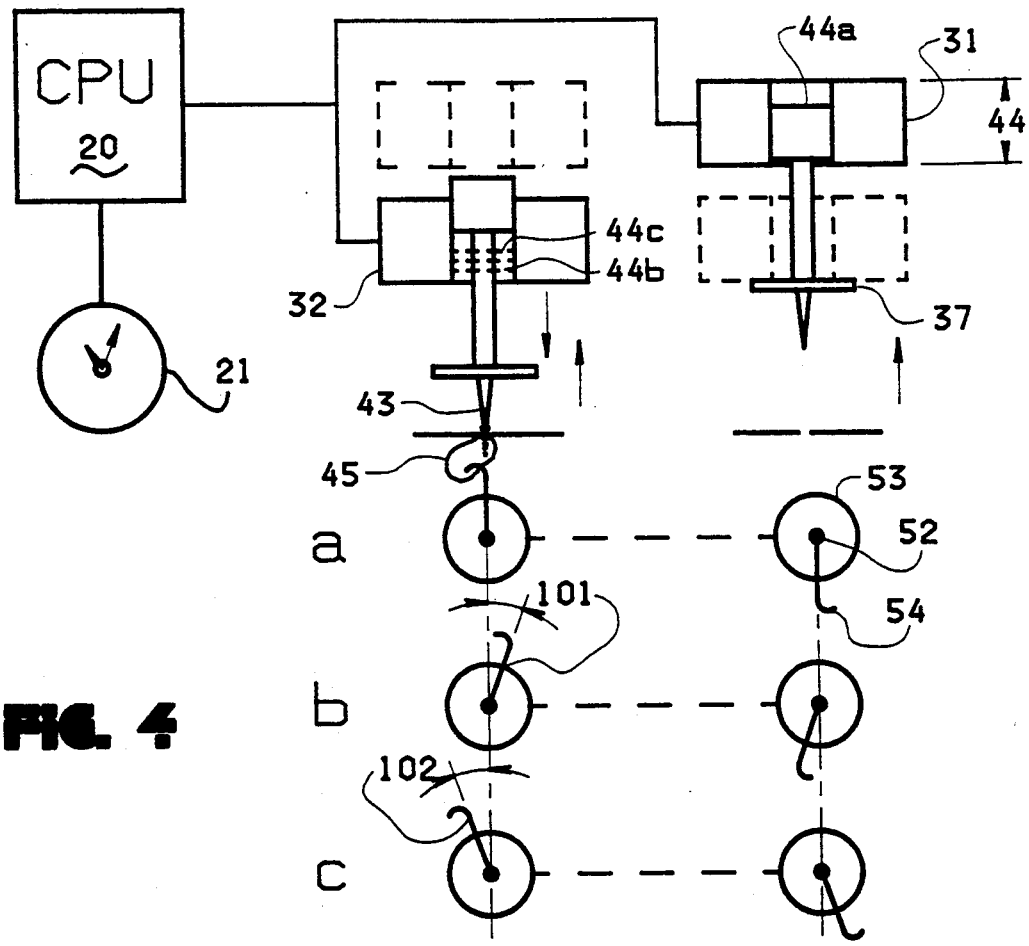
FIG. 4 is a diagrammatic sketch of the cooperative features of the bobbin assembly and the stepper motor during stitch formation.
Figure 5:
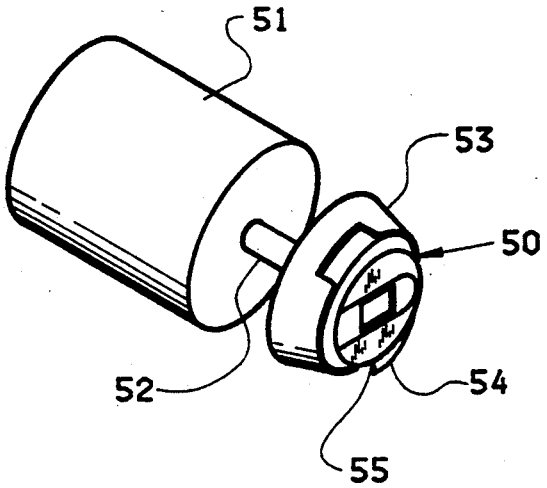
FIG. 5 shows schematic details of the bobbin assembly and the stepper motor.

Attention is directed to FIGS. 4 and 5. The bobbin assembly 50 is comprised of a rotatable bobbin case 53 which is attached rotatably to the stepper motor shaft 52 for rotation, a bobbin spool (not shown) with a supply of bobbin thread disposed inside the case, and a hook 54 having a point 55, the hook cooperating with the bobbin thread to take a loop 45 formed by the needle's reciprocation to make, for example, a lock stitch.

When the hook has started to capture the loop from a defined reference position 100 of the bobbin case as in FIG. 4 position "a," and rotates 360° it will make a stitch of a defined tightness. The bobbin case is, therefore oriented at a first reference or default position to accomplish this. By causing the bobbin case initially to rotate away from the reference position clockwise or counter-clockwise a defined arc of rotation by means of the stepper motor, the first reference position becomes changed, FIG. 4 at position "b" to a second reference position 101 or See FIG. 4 position "c") to a third reference position 102 and the tightness of the stitch shall become varied accordingly. A shift to the second reference position clockwise 101 adjacent to the first reference point will cause a tighter stitch. A shift to the counter-clockwise third reference position 102 adjacent to the first reference point will cause a looser stitch.

The first CPU is connectable to a second or host CPU 70 by cables 71 for receiving and sending information or may run independently. Additionally, the first CPU is equipped with means (not shown) for sensing at each operating part the pertinent mode or position of the part at any given instant and for transmitting such mode or position to the second CPU.

With the machine turned on, the first CPU after sending the first set of instructions to the solenoids to activate them as described below sends a second set of instructions to the stepper motor which adjustably rotates the bobbin case to the first reference or default position a defined number of degrees of rotation. If desired, a third set of instructions will rotate the bobbin case a defined arc of rotation clockwise from the first reference position to the second reference position. A fourth set of instructions will rotate the bobbin case a defined arc of rotation counter-clockwise to the third reference position. It has been estimated that the arc of rotation typically should be from zero to 2° on either side of the first reference point and up to 20° as a maximum.

Thereafter a fifth set of instructions will rotate the bobbin case through a cycle of one revolution from its first, second or third reference point accordingly, to form a stitch.

Attention is directed to FIG. 1 and FIG. 4.

When the treadle 60 is depressed, the first set of instructions is sent by means of the first CPU cooperatively with the potentiometric circuit 61 to the solenoids activating their magnetic fields alternately to cause reciprocation at a speed increasingly responsive to increased treadle pressure. The needle bar assembly is caused thereby to descend the defined travel length 44 to the down terminus 44*b*, the needle with its thread thereby piercing the pieces to be sewn together. The needle then slightly rises from the down position to a point 44*c* on the travel path to form the loop 45.

The starting time of the bobbin assembly's 360° rotation for loop taking relative to the needle position is readily calculated by the CPU by means of a sixth set of instructions since the length of the reciprocation of the needle bar assembly is known as is the time of its arrival at the down terminus from the speed of reciprocations. Therefore, the loop 45 formed by the reciprocation will be of a constant diameter if the bobbin assembly commences its loop taking at the calculated starting time which coincides with the needle bar assembly passing the travel point going upward.

A seventh set of instructions from the first CPU will cause the machine to make a run of stitches containing a defined number of stitches. An eighth set of instructions from the first CPU will cause the machine to make a defined number of runs.

With the needle in the know down terminus 44*b*, the first CPU by means of a ninth set of instructions can cause a halt to permit the operator to shift stitch run direction or by means of a tenth set of instructions halt the needle bar assembly at the up terminus 44*a* thereby allowing an operator to complete the sewing.

Figure 2:
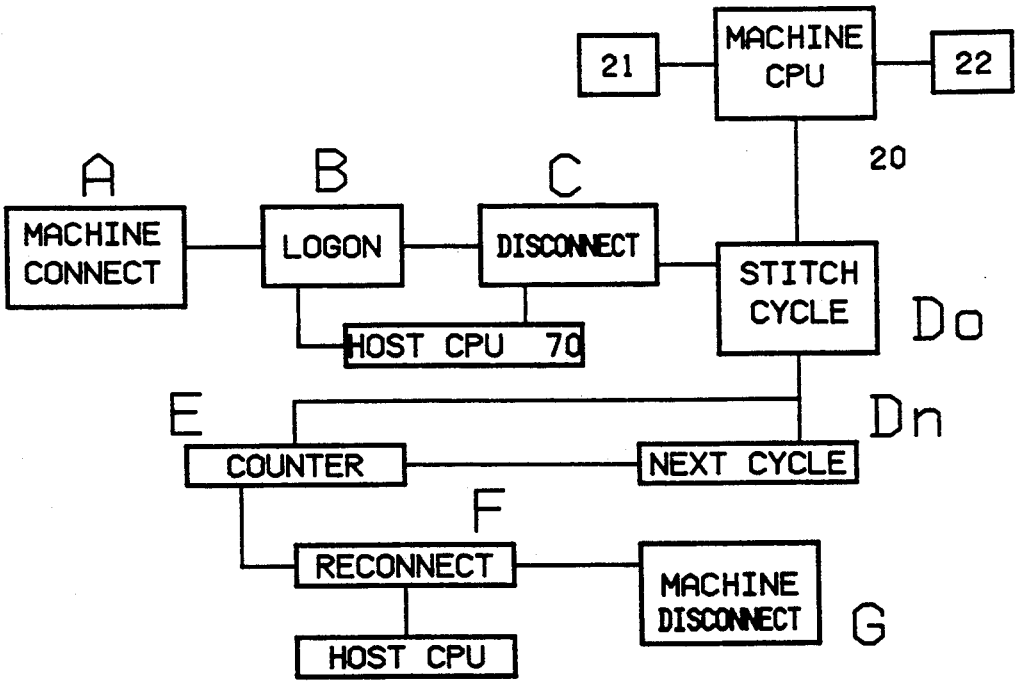
FIG. 2 is a block diagram showing how the sewing machine and its CPU interact with the operator and host computer to permit sewing.

Attention is directed to FIG. 2. An operator connects (A) the first CPU 20 to the host CPU 70 by turning it on and forwarding a machine I.D. to the host. Thereupon, the operator logs on (B) by the key pad 24 with a valid operator I.D. and job number. The host CPU 70 responds by forwarding to the first CPU's memory instructions for storage therein which are responsive to the job number, the instructions comprising the second through tenth set, i.e., the number of stitch runs, the number of stitches per run, the needle position up or down at the end of each run and the tightness of stitch, from the sixth set of instructions the time to enter the loop and the bobbin case's arc of rotation relative to the first reference position if there is no default. Thereupon the host CPU is disconnected (C) and the operator is enabled to operate the machine (Do).

It is important to note that minimal power is used by the machine since no moving part is operating except when actual stitching takes place.

As a run proceeds, the display 23 is enabled by the counter 22 to show the number of stitches left in a run. The treadle 60, being connected to the potentiometric circuit 61, enables the speed of reciprocation to vary by foot pressure. At full foot pressure, the stitch rate can be made by additional sets of instructions to approach a preprogrammed maximum and decelerate automatically as the end of a run is reached even if the operator maintains full foot pressure. The counter causes the display to decrement one number per stitch. In the event of an interruption, the operator is advised accordingly of the exact point in a job where such interruption took place, thereby enabling the job to be resumed exactly where it was stopped.

While sewing the next sewing cycle (Dn) the counter (E) is reset and the series of runs is repeated.

At the end of a job, the machine is directed to reconnect (F) to the host to report job completion, operating time from the clock, machine time if different from operating time, and the like for accounting and maintenance purposes.

Figure 3:
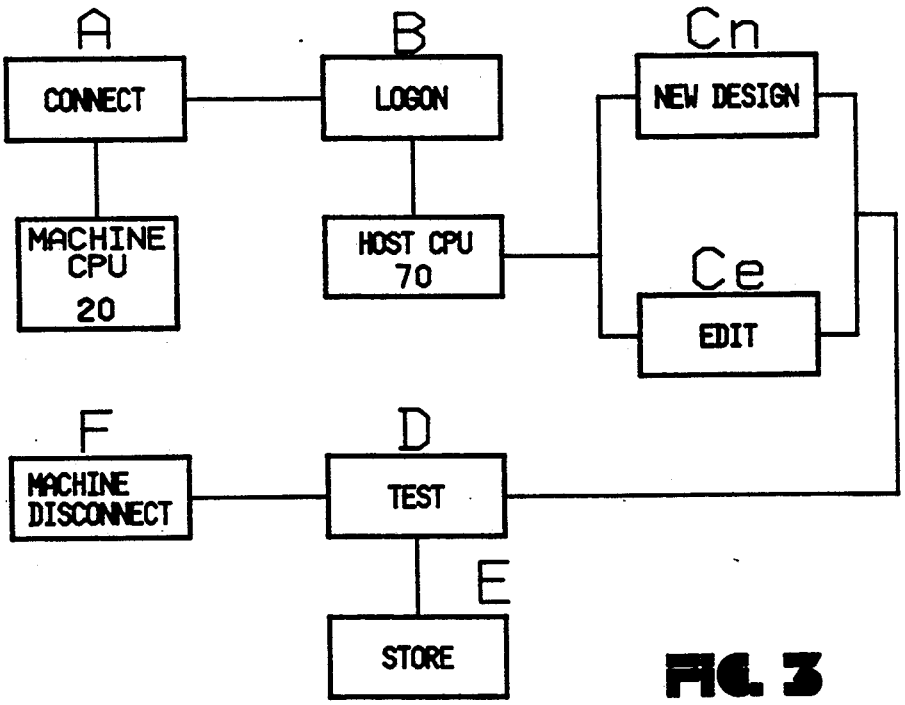
FIG. 3 is a block diagram which shows how the sewing machine may be used as an instructor to a host CPU for a new set of sewing instructions or as an editor of old ones.

See FIG. 3. A supervisor, with a new design or to edit an old one, can sit at the machine and connect the first CPU to the host CPU (A). Here the supervisor at log on (B) will inform the host that either new (Cn) or edited (Ce) instructions shall be forthcoming. It is customary initially for the supervisor at log on to provide a password to the host for security purposes. The supervisor then actually performs sewing runs and stitches per run with the desired stitch tightness which are sensed by the mode and position sensing means as information for translation into the sets of instructions which are stored in the first CPU's memory and tested (D)in the disconnect mode. If the operation is as desired, the new or edited instructions are transmitted and stored (E) as a set of job instructions in host memory and the machine is disconnected (F).

As can be seen, the supervisor at any time during a job run can halt sewing operations and edit a particular design either permanently or temporarily if job conditions, i.e. fabric variation, warrant it.

Additionally, any number of machines of the invention can retrieve from host memory instructions for any design without interfering with the operation of any other machine in connection with the host.

Since many modifications, variations and changes in detail may be made to the presently described embodiment, it is intended that all matters in the foregoing description and accompanying drawings be interpreted as illustrative and not by way of limitation.

What is claimed is:

1. An electronic sewing machine with a base, a bobbin assembly mounted under the base, a cantilevered frame mounted on the base within the frame, a needle bar assembly comprising a needle bar with a top portion and a lower holder portion in which is held a needle for sewing, a presser foot mounted on the frame adjacent to the needle, an external supply of thread under tension, a treadle and a first central processing unit for operating the machine comprising:

(a) means for storing in the first CPU a multiplicity of sets of operating instructions to operate the machine;

(b) a first and a second solenoid each with an air core and cooperatively and axially mounted vertically within the frame such that the cores form a vertical, linear passage of a defined within length with an up terminus and a down terminus and containing within the passage an iron alloy reciprocator bar attached to the head portion of the needle bar which reciprocates up and down along the defined length of the passage by magnetic action of the solenoids responsive to a first set of instructions from the first CPU so as to make one stitch for each reciprocation up and down;

(c) a stepper motor with a shaft mounted under the base adjacent to the bobbin assembly, the motor being enabled to rotate the shaft a first step which is a defined angle of rotation less than 1 revolution to a first reference position by means of a second set of instructions from the first CPU;

(d) the bobbin assembly being attached to the stepper motor shaft for rotation, said assembly having a bobbin case, a spool of thread contained within the case and, disposed outwardly from the case, a hook such that from the first reference position the bobbin assembly will cooperatively form a stitch of a defined tightness with a loop formed by the needle when the bobbin case makes one revolution.

2. An electronic sewing machine as in claim 1 wherein by means of a third set of instructions from the first CPU, the stepper motor will rotate the bobbin assembly to a second reference position clockwise from the first reference position a first defined angle of rotation such that when the bobbin case makes one clockwise revolution from the second reference position it will form a stitch which is tighter than the defined tightness of the stitch formed from the first reference position.

3. An electronic sewing machine as in claim 1 wherein by means of a fourth set of instructions from the first CPU, the stepper motor will rotate the bobbin assembly to a third reference position counter-clockwise from the first reference position a second defined angle of rotation such that when the bobbin assembly makes one clockwise revolution from the third reference position it will form a stitch which is looser than the defined tightness of the stitch formed from the first reference position.

4. An electronic sewing machine as in claim 1 wherein by means of a fifth set of instructions from the first CPU, the stepper motor will make one clockwise revolution from its reference position, the rotation commencing when the needle bar assembly passes a defined point on the needle bar travel path while traveling in a defined direction.

5. An electronic sewing machine as in claim 4 wherein the defined point on the travel path is adjacent to the down terminus and the defined direction is upward.

6. An electronic sewing machine as in claim 4 wherein a sixth set of instructions from the first CPU will calculate when the needle bar assembly passes the defined travel point in the defined direction and causes the stepper motor shaft to rotate one revolution clockwise.

7. An electronic sewing machine as in claim 6 wherein a loop of a defined diameter is formed when the needle bar assembly passes the travel point in the defined direction.

8. An electronic sewing machine as in claim 2 wherein the first defined angle of rotation position is more than zero degrees and less than 20 degrees.

9. An electronic sewing machine as in claim 8 wherein the first defined angle of rotation position is 2 degrees.

10. An electronic sewing machine as in claim 3 wherein the second defined position is more than zero degrees and less than 20 degrees.

11. An electronic sewing machine as in claim 10 wherein the second defined position is 2 degrees.

12. An electronic sewing machine as in claim 1 wherein a seventh set of instructions from the first CPU will cause the needle bar assembly to make a run of a defined number of stitches.

13. An electronic sewing machine as in claim 12 wherein an eight set of instructions will cause the needle bar assembly to make a defined number of runs of stitches.

14. An electronic sewing machine as in claim 1 wherein a ninth set of instructions from the first CPU will cause the needle bar assembly to halt t the down terminus.

15. An electronic sewing machine as in claim 1 wherein a tenth set of instructions from the first CPU will cause the needle bar assembly to halt at the up terminus.

16. An electronic sewing machine as in claim 1 wherein the machine is equipped with means to transmit signals from the machine which indicates:

(a) when the needle bar assembly is at the up or down terminus;

(b) when the solenoids are activated to cause the needle bar assembly to reciprocate up or down;

(c) what the first reference position of the bobbin case is;

(d) what the defined second or third position of the bobbin case is.

17. An electronic sewing machine as in claim 1 wherein the CPU has memory to old programming and data, a counter and a clock cooperatively assembled within the CPU.

18. A method of sewing pieces of material together comprising:

(a) placing in sewing orientation the pieces adjacent to an electronic sewing machine whose needle bar assembly is driven in its reciprocation by alternating magnetic fields and whose operation is controlled by a first central processing unit comprising:

(i) a base, a bobbin assembly mounted under the base, a cantilevered frame mounted on the base within the frame, a needle bar assembly comprising of a needle bar with a top portion and a lower holding portion in which is held a needle for sewing, a presser foot mounted on the frame adjacent to the needle, an external supply of thread under tension, a treadle and a first central processing unit for operating the machine;

(i) means for storing within the first CPU a multiplicity of sets of operating instructions to operate the machine;

(iii) a first and a second solenoid each with an air core and cooperatively and axially mounted vertically within the frame such that the cores form a vertical, linear passage of a defined length with an up terminus and a down terminus and containing within the passage an iron alloy reciprocator bar attached to the head portion of the needle bar which reciprocates up and down along the defined length of the passage by magnetic action of the solenoids responsive to a first set of instructions from the first CPU so as to make one stitch for each reciprocation up and down;

(iv) a stepper motor with a shaft mounted under the base adjacent to the bobbin assembly, the motor being enabled to rotate the shaft a first step which is a defined angle of rotation less than 1 revolution to a first reference position by means of a second set of instructions from the first CPU;

(v) the bobbin assembly being attached to the stepper motor shaft for rotation, said assembly having a bobbin case, a spool of thread contained within the case and disposed outwardly from the case, and a hook such that from the first reference position the bobbin assembly will cooperatively form a stitch of a defined tightness with a loop formed by the needle when the bobbin case makes one revolution (b) turning the machine on;

(c) causing the machine to stitch the materials together, said method further comprising reading out a third set of instructions from the first CPU to the stepper motor, rotating the bobbin assembly to a second reference position clockwise from the first reference position through a first defined angle of rotation such that when the bobbin case makes one clockwise revolution from the second reference position, it will form a stitch which is tighter than the defined tightness of the stitch formed from the first reference position.

19. A method of sewing pieces of material together as in claim 18 further comprising a fourth set of instructions from the first CPU to the stepper motor, rotating the bobbin case to a third reference position counter-clockwise from the first reference position a second defined angle of rotation such that when the bobbin case makes one clockwise revolution from the third reference position it will form a stitch which is looser than the defined tightness of the stitch formed from the first reference position.

20. A method of sewing pieces of material together as in claim 18 further comprising a fifth set of instructions from the first CPU to the stepper motor, rotating one clockwise revolution from its reference position, the rotation commencing when the needle bar assembly passes a defined point on the needle bar travel path while traveling in a defined direction.

21. A method of sewing pieces of material together as in claim 20 wherein the defined point on the travel path is adjacent to the down terminus and the defined direction is upward.

22. A method of sewing pieces of material together as in claim 20 wherein a sixth set of instructions from the first CPU will calculate when the needle bar assembly passes the defined travel point in the defined direction causing the stepper motor shaft to rotate one revolution clockwise.

23. A method of sewing pieces of material together as in claim 22 wherein a loop of a defined diameter is formed when the needle bar assembly passes the travel point in the defined direction.

24. A method of sewing pieces of material together as in claim 19 wherein the second defined position is more than zero degrees and less than 20 degrees.

25. A method of sewing pieces of material together as in claim 24 wherein the third reference position is 2 degrees.

26. A method of sewing pieces of material together as in claim 18 wherein the seventh set of instructions from the first CPU the needle bar assembly will make a run of a defined number of stitches.

27. A method of sewing pieces of material together as in claim 26 wherein the eight set of instructions from the first CPU the needle bar assembly will make a defined number of runs of stitches.

28. A method of sewing pieces of material together as in claim 18 wherein the ninth set of instructions from the first CPU will cause the needle bar assembly to halt t the down terminus.

29. A method of sewing pieces of material together as in claim 18 wherein the tenth set of instructions from the first CPU will cause the needle bar assembly to halt at the up terminus.

30. A method of programming an electronic sewing machine as set forth in claim 1 comprising:

(a) connecting the machine and the first CPU to a second or host CPU;

(b) causing the second CPU to receive signals transmitted from the first CPU which indicate:

(i) when the needle bar assembly is at the up or down terminus;

(ii) when the solenoids are activated to cause the needle bar assembly to reciprocate up or down;

(iii) what the first reference position of the bobbin case is;

(iv) what the defined second or third position of the bobbin case is;

(c) translating the signals into a multiplicity of set of instructions;

(d) testing the translated instructions by transmitting them to the first CPU from the second CPU and operating the machine in accordance with the transmitted instructions;

(e) causing the second CPU to store the instructions.

31. A bobbin assembly for an electric sewing machine with a needle and an external source of thread comprising:

(a) a stepper motor with a shaft, the stepper motor having a shaft rotting within a definable arc;

(b) a bobbin case which is disk-shaped having a perimeter and a major surface which is attached to the shaft for rotation, the bobbin case containing a spool of bobbin thread and having a hook means disposed on the perimeter cooperatively connected to the bobbin thread;

(c) a central processing unit with a memory to receive, store and transmit a multiplicity of sets of instructions, the instructions being in the form of pulses which will cause the motor to rotate steps clockwise and counter-clockwise;

wherein the bobbin case will form, in cooperation with a loop formed by the sewing machine needle and the external source of thread, a stitch of defined tightness when the bobbin case is caused to rotate 360 degrees clockwise from a first reference position.

32. A bobbin assembly as in claim 31 wherein a first et of instructions transmitted by the CPU to the stepper motor will cause it to rotate in steps to the first reference position.

33. A bobbin assembly as in claim 31 wherein a second set of instructions transmitted by the CPU to the stepper motor will cause it to rotate in steps to a defined second reference position which is clockwise of the first reference position such that when the bobbin case makes one revolution clockwise, it will form a stitch which is tighter than the defined tightness of a stitch formed from the first reference position.

34. A bobbin assembly as in claim wherein a third set of instructions transmitted by the CPU to the stepper motor will cause it to rotate in steps to a defined third reference position which is counter-clockwise of the first reference position such that when the bobbin case makes one revolution clockwise it will form a stitch which is looser than the defined tightness of the stitch formed from the first reference position.

35. A bobbin assembly as in claim 31 wherein a fourth set of instructions transmitted by the CPU to the stepper motor will cause it to rotate one revolution from its reference position.

* * * * *